US005913414A

United States Patent [19]

Pollock et al.

[11] Patent Number: 5,913,414

[45] Date of Patent: Jun. 22, 1999

[54] ILLUMINATED SWITCH APPARATUS

[75] Inventors: Scott J. Pollock, Ypsilanti; Nick Smith, Southfield, both of Mich.

[73] Assignee: TRW Inc., Lyndhurst, Ohio

[21] Appl. No.: 09/038,587

[22] Filed: Mar. 11, 1998

[51] Int. Cl.[6] ..... H01H 9/00

[52] U.S. Cl. ..... 200/316; 362/29

[58] Field of Search ..... 200/5 R, 308, 200/310, 313, 316, 336, 314; 362/23, 24, 26, 29, 30; 340/815.42, 815.47

[56] References Cited

U.S. PATENT DOCUMENTS

| | | | |
|---|---|---|---|
| 2,449,213 | 9/1948 | Fredrick . | |
| 2,693,165 | 11/1954 | Appleman . | |
| 4,104,981 | 8/1978 | Ono et al. . | |
| 4,176,265 | 11/1979 | Mobus et al. | 200/316 |
| 4,264,799 | 4/1981 | Aspden | 200/327 |
| 5,180,050 | 1/1993 | Rada et al. . | |
| 5,204,502 | 4/1993 | Ferris et al. . | |
| 5,359,165 | 10/1994 | Leveque et al. | 200/317 |
| 5,434,756 | 7/1995 | Hsu et al. . | |

OTHER PUBLICATIONS

"Refraction" and Refractive Index, Van Norstrand's Scientific Encyclopedia Sixth Edition, pp. 2421–2422, 1983.

*Primary Examiner*—Michael L. Gellner
*Assistant Examiner*—Nhung Nguyen
*Attorney, Agent, or Firm*—Tarolli, Sundheim, Covell, Tummino & Szabo

[57] ABSTRACT

An apparatus (10) comprises a manually rotatable knob (14) and a source (18) of light. The knob (14) has an axis (15) of rotation, and has a discrete light-transmitting portion (40) which is spaced from the axis (15). A hollow part (36) of the knob (14) defines a chamber (39) extending from the axis (15) to the light-transmitting portion (40). A rotor (22) extends along the axis (15) from the chamber (39) to the source (18) of light. The rotor (22) is formed of material which is translucent sufficiently to transmit light from the source (18) to the chamber (39) to flood the chamber (39) with light, and thereby to illuminate the light-transmitting portion (40) of the knob (14).

6 Claims, 2 Drawing Sheets

ILLUMINATED SWITCH APPARATUS

FIELD OF THE INVENTION

The present invention relates to a switch for use in a vehicle, and particularly relates to a switch that is illuminated for visibility in a vehicle occupant compartment.

BACKGROUND OF THE INVENTION

A plurality of switches are accessible for manual operation in a vehicle occupant compartment. Such switches, particularly those on the instrument panel, may be illuminated, for example, it is known to use back-lighting to illuminate graphics on a headlight switch. This helps the driver locate and distinguish the headlight switch from other switches on the instrument panel.

SUMMARY OF THE INVENTION

In accordance with the present invention, an apparatus comprises a manually rotatable knob and a source of light. The knob has an axis of rotation, and has a discrete light-transmitting portion which is spaced from the axis. A hollow part of the knob defines a chamber extending from the axis to the light-transmitting portion. A rotor extends along the axis from the chamber to the source of light. The rotor is formed of material which is translucent sufficiently to transmit light from the source to the chamber to flood the chamber with light, and thereby to illuminate the light-transmitting portion of the knob.

In a preferred embodiment of the present invention, the rotor has a light-transmitting surface within the chamber. The light-transmitting surface of the rotor defines an angle of refraction which is specified with reference to the location of the light-transmitting portion of the knob.

BRIEF DESCRIPTION OF THE DRAWINGS

The foregoing and other features of the present invention will becomes apparent to one skilled in the art to which the present invention relates upon reading the following description with reference to the accompanying drawings, wherein.

DESCRIPTION OF A PREFERRED EMBODIMENT

Figure 1:
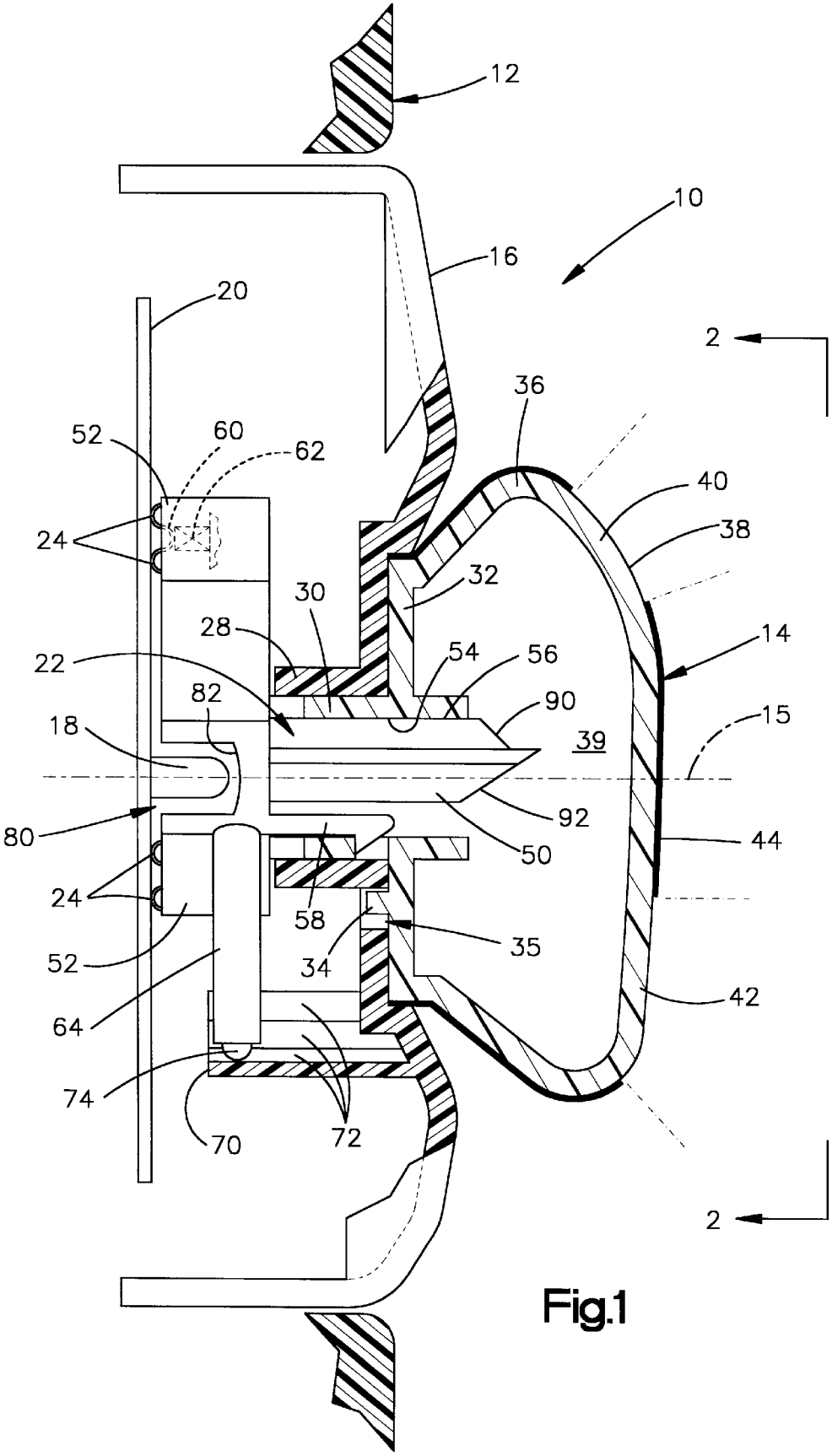
FIG. 1 is a side view, partly in section, of an apparatus comprising a preferred embodiment of the present invention.

A switch 10 comprising a preferred embodiment of the present invention is shown in FIG. 1. The switch 10 is mounted on a vehicle instrument panel 12, and includes a manually rotatable knob 14 with an axis 15 of rotation. In the preferred embodiment of the present invention, the knob 14 is supported for rotation on a separate trim portion 16 of the instrument panel 12 which is known as a bezel. A source 18 of light for illuminating the knob 14 is mounted on a circuit board 20 behind the bezel 16.

A rotor 22 projects axially through the bezel 16 from the knob 14 to the circuit board 20. The rotor 22 is coupled with the knob 14 for rotation about the axis 15. When a vehicle occupant rotates the knob 14 between selected positions on the bezel 16, the rotor 22 carries a plurality of electrical contacts 24 between corresponding positions on the circuit board 20. In accordance with the present invention, the rotor 22 is formed of a translucent plastic material, and further functions to transmit light from the source 18 to the knob 14.

The bezel 16 has a cylindrical central portion 28 defining a hub centered on the axis 15. The knob 14 has a cylindrical central portion 30 received within the hub 28 for rotation about the axis 15. A base wall 32 of the knob 14 projects radially from the central portion 30. A tab 34 on the base wall 32 projects axially into a slot 35 in the bezel 16. The tab 34 limits rotation of the knob 14 to a range defined between opposite ends of the slot 35.

Figure 2:
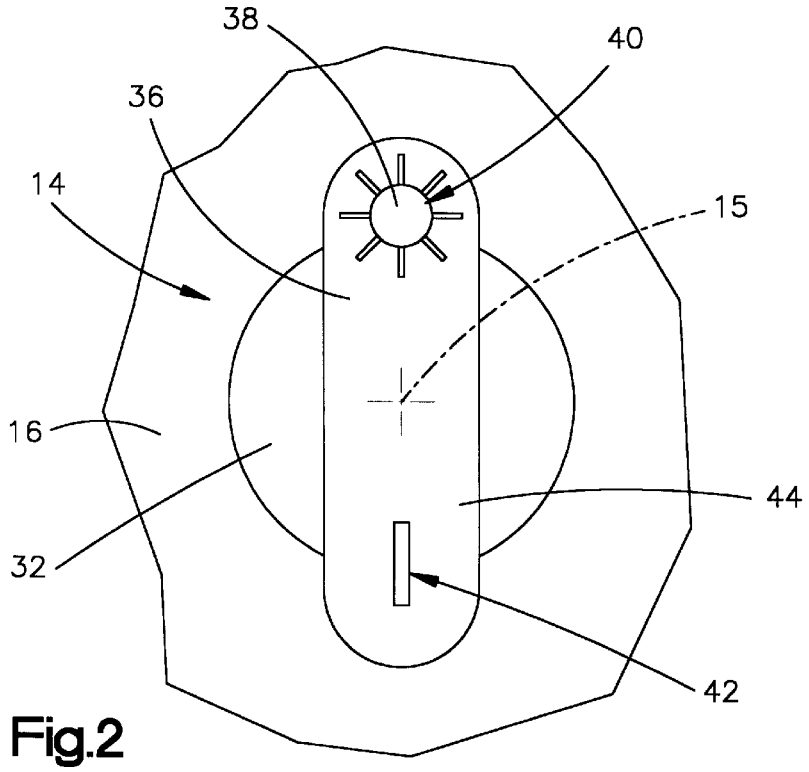
FIG. 2 is a view taken on line 2—2 of FIG. 1.

A hollow body portion 36 of the knob 14 projects both radially and axially from the base wall 32. As shown in FIG. 2, the hollow body 36 is elongated in a direction perpendicular to the axis 15. The hollow body 36 thus has a narrow front edge surface 38 with an elongated shape extending longitudinally across the axis 15. A chamber 39 (FIG. 1) with a corresponding shape extends longitudinally across the axis 15 within the hollow body 36.

The knob 14 has a pair of discrete light-transmitting portions 40 and 42 which are configured as graphics to be viewed by an occupant of the vehicle. Specifically, the structural portions 32, 34 and 36 of the knob 14 are formed of a translucent plastic material. When the knob 14 is being manufactured, a coating 44 of opaque paint is applied fully over all of the surfaces that would otherwise be exposed to view in the vehicle occupant compartment. The coating 44 of paint is then etched away at opposite end portions of the hollow body 36 to expose corresponding areas of the front edge surface 38, and thereby to define the light-transmitting portions 40 and 42 of the knob 14 at opposite ends of the hollow body 36.

The rotor 22 in the preferred embodiment is a one piece structure including a shaft 50 and a pair of switching arms 52. The shaft 50 extends through the central portion 32 of the knob 14 along the axis 15. An inner surface 54 of the central portion 32 has a non-cylindrical contour, and mates with a non-cylindrical peripheral surface 56 of the shaft 50 to interlock the rotor 22 and the knob 14 rotationally. A snap fastener 58 on the rotor 22 interlocks the rotor 22 and the knob 14 axially.

The switching arms 52 project radially from the shaft 50 at locations behind the bezel 16. The electrical contacts 24 are arranged in pairs at the outer ends of the switching arms 52. In the preferred embodiment of the present invention, each pair of contacts 24 is defined by a single bent wire 60 which is biased against the circuit board 20 by a corresponding spring 62.

A tubular portion 64 of the rotor 22 also projects radially outward at a location behind the bezel 16. An adjacent portion 70 of the bezel 16 is configured as a locator structure with a plurality of axially extending grooves 72. A spring-biased detent member 74 projects from the tubular portion 64 of the rotor 22 into engagement with the locator structure 70. Accordingly, the knob 14, the rotor 22 and the contacts 24 are rotatable together between positions defined by the grooves 72 on the locator structure 70, and are releasably retained in any selected one of those positions by the detent member 74.

The circuit board 20, which is shown schematically in FIG. 1, comprises electrical circuitry for operation of vehicle components, such as headlights, as selected by a vehicle occupant. The circuit board 20 thus comprises electrical circuitry that is switched between differently energized conditions upon movement of the contacts 24 between the positions defined by the grooves 72 in the locator structure 70.

The source 18 of light, which also is shown schematically, preferably is an incandescent bulb. The bulb 18 projects into an axially recessed pocket 80 at the inner end of the rotor 22, and is closely spaced from an inner surface 82 of the rotor 22 which extends across the axis 15 at the inner end of the pocket 80. The bulb 18 is thus oriented to project light axially into and through the rotor 22 along the length of the shaft 50.

The plastic material of the rotor 22 is translucent sufficiently to transmit light axially through the shaft 50 from the bulb 18 to the chamber 39 so as to flood the chamber 39 with light. This provides back lighting at the light-transmitting portions 40 and 42 of the knob 14. A preferred material for the rotor 22 is a clear polycarbonate resin available from G. E. Plastics of Pittsfield, Mass., with the trademark "Lexan."

As further shown in FIG. 1, the rotor 22 has a pair of light-transmitting surfaces 90 and 92 within the chamber 39. The light-transmitting surfaces 90 and 92 are configured with reference to the locations of the light-transmitting portions 40 and 42 of the knob 14 at opposite ends of the chamber 39.

Figure 3:
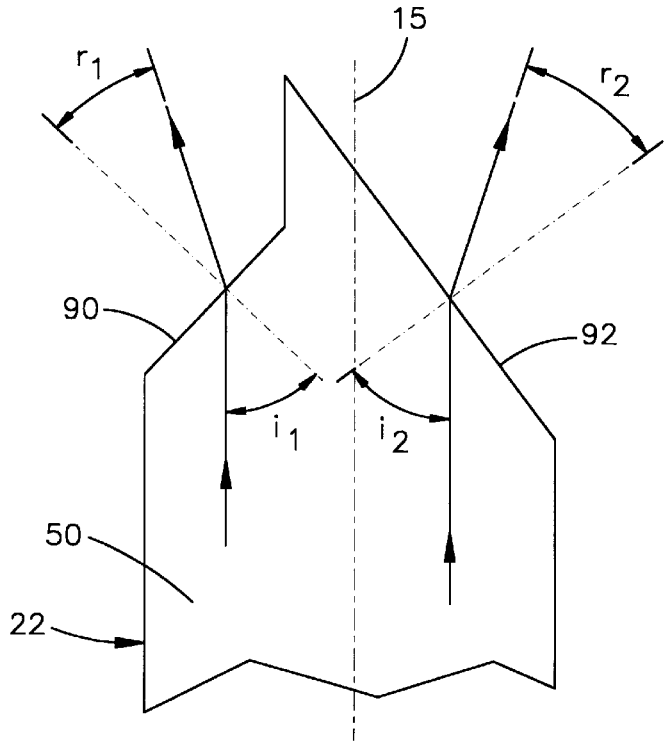
FIG. 3 is a schematic partial view of a part of the apparatus of FIG. 1.

Each of the light-transmitting surfaces 90 in the preferred embodiment is a planar terminal end surface of the shaft 50. As shown schematically in FIG. 3, the first light-transmitting surface 90 defines an angle of refraction $r_1$ for light with an angle of incidence $i_1$, i.e., light that is transmitted through the shaft 50 in a direction parallel to the axis 15. The angle of refraction $r_1$ is determined in accordance with the following expression of Snell's law:

$$\sin i = n \sin r$$

in which the refractive index n is known for the material of which the rotor 22 is formed. Moreover, the angle of refraction $r_1$ has a value that is specified in accordance with the present invention such that light having the angle of incidence $i_1$ is refracted away from the axis 15 generally toward the first light-transmitting portion 40 of the knob 14 (FIG. 1). This helps to enhance flood-lighting of the chamber 39 between the shaft 50 and the first light-transmitting portion 40 of the knob 14. The second light-transmitting surface 92 likewise defines an angle of refraction $r_2$ which is specified with reference to the location of the second light-transmitting portion 42 of the knob 14. This helps to enhance flood lighting of the chamber 39 between the shaft 50 and the second light-transmitting portion 42 of the knob 14 in accordance with the present invention.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

a manually rotatable knob having an axis of rotation, said knob having a discreet light-transmitting portion spaced from said axis and comprising a hollow structure defining a chamber extending from said axis to said light-transmitting portion;

a rotor projecting from said chamber along said axis; and a source of light adjacent to said rotor at a location spaced from said knob;

said rotor being formed of material which is translucent sufficiently to transmit light from said source to said chamber to flood said chamber with light, and thereby to illuminate said light-transmitting portion of said knob.

2. Apparatus as defined in claim 1 wherein said rotor has a light-transmitting surface within said chamber, said light-transmitting surface of said rotor defining an angle of refraction which is specified with reference to the location of said light-transmitting portion of said knob.

3. Apparatus as defined in claim 2 wherein said light-transmitting surface of said rotor is planar and is inclined relative to said axis.

4. Apparatus as defined in claim 2 wherein said light-transmitting surface of said rotor is a terminal end surface of said rotor.

5. Apparatus as defined in claim 2 wherein said rotor defines an axially recessed pocket, said source of light being received in said pocket.

6. Apparatus as defined in claim 2 further comprising an electrical contact mounted on said rotor at a location spaced from said knob.

* * * * *